US005467810A

United States Patent [19]

Grove

[11] Patent Number: 5,467,810

[45] Date of Patent: Nov. 21, 1995

[54] CONTINUOUS METAL CASTING MOLD

[75] Inventor: John A. Grove, Franklin, Pa.

[73] Assignee: Acutus Industries, Waterford, Mich.

[21] Appl. No.: 221,954

[22] Filed: Apr. 1, 1994

[51] Int. Cl.[6] ..... B22D 11/04

[52] U.S. Cl. ..... 164/418; 164/443

[58] Field of Search ..... 164/418, 459, 164/443

[56] References Cited

U.S. PATENT DOCUMENTS

| | | | |
|---|---|---|---|
| 3,709,286 | 1/1973 | Bower, Jr. . | |
| 3,964,727 | 6/1976 | Gladwin . | |
| 3,967,673 | 7/1976 | Bower, Jr. . | |
| 4,589,468 | 5/1986 | Misera et al. . | |
| 4,635,702 | 1/1987 | Kolakowski et al. . | |
| 4,911,226 | 3/1990 | Cleary et al. | 164/418 |
| 5,172,749 | 12/1992 | Flemming . | |
| 5,188,167 | 2/1993 | Perry et al. | 164/418 |

FOREIGN PATENT DOCUMENTS

| | | | |
|---|---|---|---|
| 1919710 | 11/1970 | Germany | 164/418 |
| 4318105 | 12/1993 | Germany . | |
| 57-209748A | 6/1981 | Japan . | |
| 57-209749A | 12/1982 | Japan . | |
| 57-209748 | 12/1982 | Japan | 164/418 |
| 59-174250A | 10/1984 | Japan . | |
| 61-176444A | 8/1986 | Japan . | |
| 62-77150A | 4/1987 | Japan . | |
| 63-126644 | 5/1988 | Japan | 164/418 |
| 270358A | 3/1990 | Japan . | |
| 4-17952A | 5/1990 | Japan . | |
| 4-17952 | 1/1992 | Japan | 164/443 |
| 4190898A | 8/1986 | U.S.S.R. . | |

OTHER PUBLICATIONS

International Search Report, dated May 22, 1995, for International Application No. PCT/US95/03867, International Filing Date: Mar. 29, 1995.

*Primary Examiner*—Kuang Y. Lin
*Attorney, Agent, or Firm*—Dykema Gossett

[57] ABSTRACT

An improved continuous metal casting mold incorporating a removable cassette insert member that has a uniform thickness copper facing plate and a steel backing plate fastened together in such a way as to allow three dimensional expansion of the copper plate in relation to the steel plate to minimize the thermal stresses exerted on the copper plate and the temperature differential along the surface of the copper plate.

12 Claims, 3 Drawing Sheets

CONTINUOUS METAL CASTING MOLD

FIELD OF THE INVENTION

The present invention generally relates to an improved continuous metal casting mold incorporating a removable cassette insert member and more particularly, relates to an improved continuous metal casting mold incorporating a removable cassette insert member that has a uniform thickness copper facing plate and a steel backing plate fastened together in such a way as to allow three dimensional expansion of the copper plate in relation to the steel plate to minimize the thermal stresses exerted on the copper plate and the temperature differential along the surface of the copper plate.

BACKGROUND OF THE INVENTION

Continuous metal casting mold has been used for many years in the casting of metal sheets or slabs. A typical continuous-casting mold is a double-walled open-ended sleeve. The inner wall or the liner is usually formed of a high heat conductance material such as copper to furnish maximum thermal conductance. The outer wall or backing is usually formed of steel to furnish mechanical strength. Liquid metal is poured into the top of the mold and a partially solidified casting emerges continuously from the bottom of the mold. Cooling channels are formed between the backing and the liner through which water circulates to cool the liner and to help solidify the metal. The cooling channels can be machined into either the copper liner or the steel backing, but frequently into the steel backing to conserve copper material which is substantially more costly. The copper liner and the steel backing are fastened together by drilling and tapping holes in the outside surface of the copper liner and threading metal studs into these openings. The metal studs extend through mating openings in the backing plate and carry nuts which hold the copper plate and the steel plate securely in place. The conventional construction of a metal casting mold requires the use of a thick-walled copper liner to provide support for the studs which creates undesirable stress patterns.

U.S. Pat. No. 3,709,286 discloses a method for reducing the wall thickness of the copper liner by welding the studs to the copper liner either directly or through the use of intermediate metal strips. However, the construction of the mold proposed by the patent does not afford adjustability of the mold thickness or width and furthermore, does not provide a flexible mounting system between the copper liner and the steel backing so as to avoid thermal stress shock.

U.S. Pat. No. 3,964,727 discloses a continuous metal casting mold constructed of a pair of spaced apart mold plate members and a pair of mold side members to form an open-ended mold cavity for continuously casting metal there through. Even though the width of the mold can be adjusted to produce variable width metal castings, the patented device does not have any provisions to relieve the stress on the copper facing of the mold.

U.S. Pat. No. 4,635,702 discloses a mold for continuous casting of a steel strip that has two broad sidewalls opposing each other and are connected to two narrow walls arranged between the two sidewalls. The upper portion of the sidewalls defines a funnel-shaped casting area to accept molten metal. Since the broad sidewalls of the mold are of non-uniform thickness, there is a high likelihood that stress cracking problems caused by uneven thermal expansion in the sidewalls will occur. Moreover, the cost of such a thick-wall mold made of copper is very high and so is the maintenance cost of such a mold.

It is therefore an object of the present invention to provide an improved continuous metal casting mold that does not have the shortcomings of those prior art metal casting molds.

It is another object of the present invention to provide an improved continuous metal casting mold incorporating an insert and a mold frame from which the insert may be removed for service.

It is a further object of the present invention to provide an improved continuous metal casting mold that utilizes a thin, uniform-thickness copper facing plate fastened to a steel backing plate wherein the copper facing plate can be easily removed for service or replaced at relatively low cost.

It is another further object of the present invention to provide an improved continuous metal casting mold that utilizes an insert of a copper facing plate bolted to a steel backing plate in a floating arrangement such that the difference in thermal expansion between copper and steel can be compensated.

It is yet another object of the present invention to provide an improved continuous metal casting mold that utilizes a copper facing plate fastened to a steel backing plate in a flexible mounting arrangement such that it allows three dimensional movement of the copper plate in relation to the steel plate.

It is yet another further object of the present invention to provide an improved continuous metal casting mold that provides an expansion gap in the interface between the copper facing plate and the steel backing plate to allow for uneven expansion between copper and steel.

It is still another object of the present invention to provide an improved continuous metal casting mold that utilizes a thin copper facing plate which has uniform thickness to minimize thermal stresses and to maximize the wear life of the plate.

SUMMARY OF THE INVENTION

In accordance with the present invention, an improved continuous metal casting mold can be constructed by an insert and a mold frame from which the insert may be removed for service.

In the preferred embodiment, the insert is constructed with a pair of primary plate-like mold members juxtaposed in a spaced, substantially parallel relationship and a pair of end mold members opposing each other and situated between the plate-like mold members. Each of the primary plate-like mold member is constructed of a copper facing plate and a steel backing plate fastened together by a floating fastening means. The copper facing plate has an uniform thickness across its entire surface area and a central upper portion that expands outwardly to provide a downwardly converging funnel-shaped area for receiving molten metal. The steel backing plate has a contour in the surface facing the copper plate that mates with the funnel-shaped contour of the copper plate. The back of the steel backing plate is flat. Cooling channels are provided between the copper facing plate and the steel backing plate to conduct heat away from the molten metal such that it solidifies partially as it emerges from the bottom opening of the mold.

The floating fastening means, or the flexible mounting means between the copper facing plate and the steel backing plate is made possible by the combination of a plurality of oversized mating holes to the mounting studs on the back of the copper facing plate and a plurality of disc-shaped spring washers. This flexible mounting method allows three dimensional movements of the copper facing plate in relation to the steel backing plate such that the thermal stress in the copper plate can be minimized and the service life of the plate can be extended.

In an alternate embodiment, the improved continuous metal casting mold incorporates the use of an expansion gap in the interface between the copper facing plate and the steel backing plate by building into the steel backing plate at its center line a flat plateau area of approximately ⅛ inch wide along the full length of the plate to allow expansion of the copper facing plate at its centerline position.

BRIEF DESCRIPTION OF THE DRAWINGS

These and other features, objects and advantages of the present invention will become more apparent from the following detailed descriptions and drawings, in which.

DETAILED DESCRIPTION OF THE PREFERRED EMBODIMENTS

Figure 1:
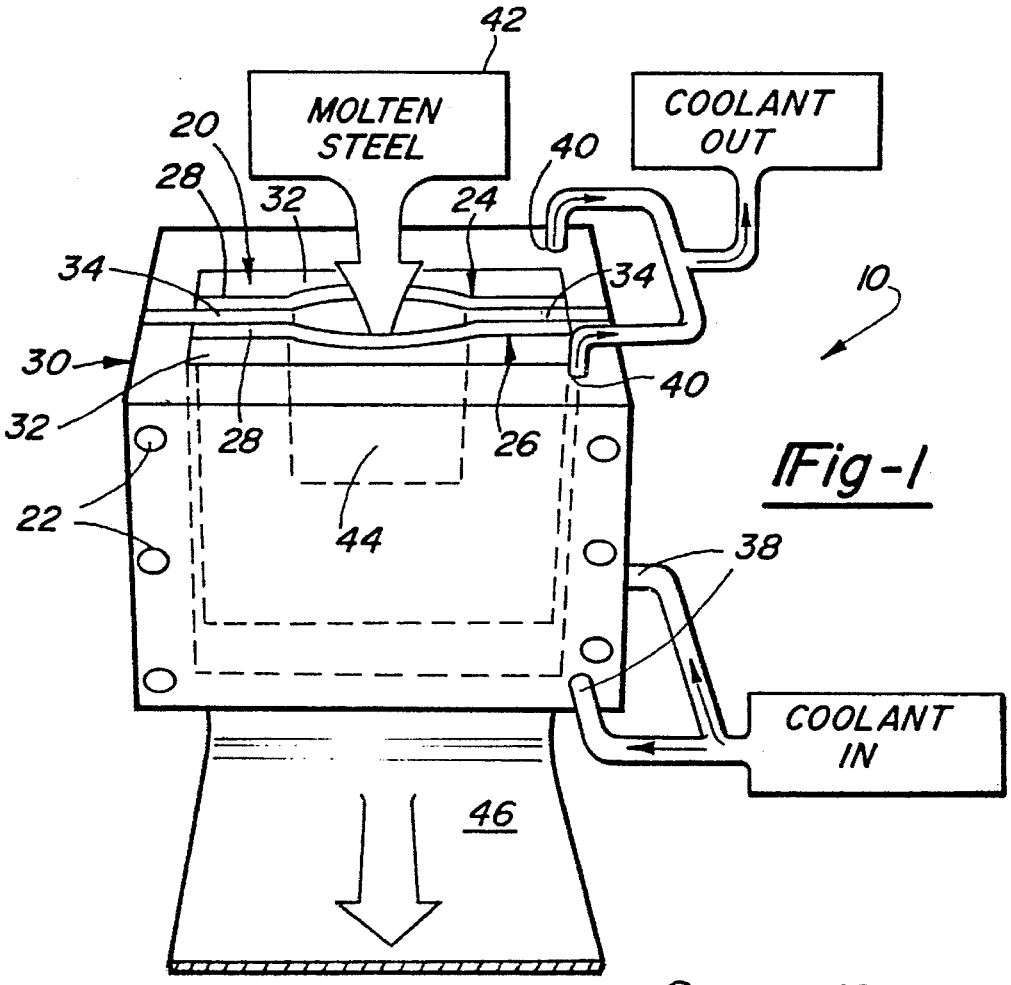
FIG. 1 is a perspective view of the present invention casting mold constructed of an insert and a mold frame.

Referring initially to FIG. 1, wherein a perspective view of the present invention casting mold 10 constructed of an insert 20 and a mold frame 30 is shoe. The insert 20 is sometimes called a cassette since it can be easily removed from the mold frame 30 for servicing or replacement. Bolts 22 are used to tighten the mold frame 30 together such that insert 20 can be securely retained in the frame. Insert 20 is constructed of a pair of primary plate-like mold members 24 and 26 which are juxtaposed in a spaced substantially parallel relationship with each other. Each primary plate-like mold member has a copper facing plate 28 and a steel backing plate 32. A pair of end mold members 34 are installed between the primary plate-like mold members 24 and 26 to form the mold opening 36. The end mold members 34 are normally faced with a copper layer to facilitate thermal conductance. It should be noted that FIG. 1 is presented for illustration purposes only and is not drawn to scale. For instance, the mold frame 30, frequently called a waterbox, is normally larger in proportion than that shown in FIG. 1 so that insert 20 can be efficiently cooled. The details of the construction of mold frame 30 is conventional and therefore is not shown.

Coolant such as room temperature water is pumped into the mold frame 30 at inlet 38 and circulated in-between the copper facing plate 28 and the steel backing plate 32 before it is exhausted through outlet 40 at the top of mold frame 30. In operation, molten steel 42 is fed into opening 36 which is funnel-shaped to facilitate flow and flown through a downwardly converging area 44 of insert 20. After sufficient cooling, a partially solidified metal slab 46 can be pulled away from the bottom opening of the casting mold 10.

Figure 2:
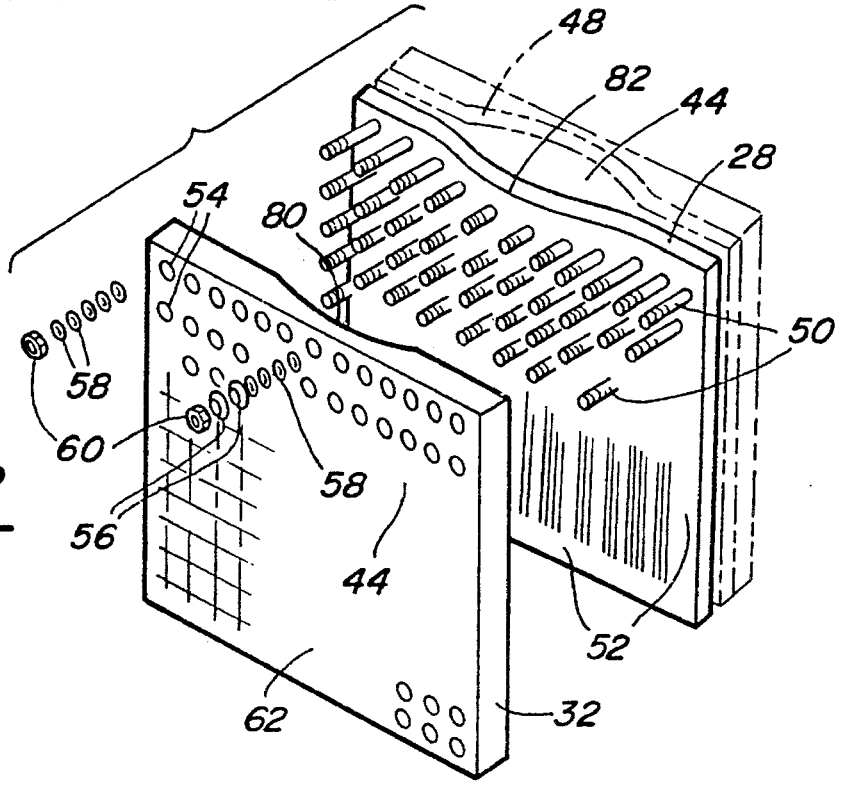
FIG. 2 is a perspective view of the insert which is constructed of a copper facing plate and a steel backing plate.

FIG. 2 shows a detailed perspective view of the copper facing plate 28 and the steel backing plate 32 with the opposite half of the copper facing plate 48 shown in ghost lines. The copper facing plate 28 is normally forged and has a uniform thickness throughout its entire surface area such that thermal stress in the plate is minimized and any resulting stress cracking problem is avoided. The thickness of the steel backing plate is not uniform with the central upper section thinner than the other sections of the plate. The steel backing plate is normally machined.

The novel casting mold of the present invention is assembled together by a unique floating fastening method. A plurality of mounting studs 50 are mounted into tapped and drilled holes in the back surface 52 of the copper facing plate 28. These mounting studs 50 may also be welded to the back surface 52. In order to overcome the shortcomings of the prior art cassette type casting molds, it was discovered that the thermal stresses in the copper facing plate must be minimized. This is accomplished by the unique floating fastening method. A plurality of mating holes 54 are provided in the steel backing plate 32 corresponding to the locations of the mounting studs 50 on the copper facing plate 28. Within the curved area 44 of the copper facing plate 28 which is the central upper portion that expands outwardly providing a downwardly converging funnel-shaped opening 36, the mounting studs 50 are fastened to the steel backing plate 32 by a unique floating fastening method. For instance, as shown in FIG. 2, at least one disc-shaped spring washer 56 and gaskets of steel or foam 58 are used under nut 60 for fastening mounting studs 50. While in the flat area 52 of the copper facing plate 28, only gaskets 58 are used.

The flexible mounting or floating fastening method is achieved in two ways. First, the mounting holes 54 in the steel backing plate 32 are made oversized in relation to the diameters of mounting studs 50. This can be seen in FIG. 7. The extra clearance in mounting holes 54 allows lateral or two dimensional movements of mounting studs 50, and thus the copper facing plate, when fastened by nut 60. The use of at least one disc-shaped spring washer 56, i.e. frequently two are stacked together, allows movement of the copper facing plate 28 away or toward the steel backing plate 32 in the direction perpendicular to the plates. As a result, the flexible mounting method of the present invention allows a three dimensional movement of the copper facing plate 28 in relation to the steel backing plate 32. This is an important prerequisite for the minimization of thermal stresses exerted on the copper facing plate 28 by the steel backing plate 32.

Figure 3:
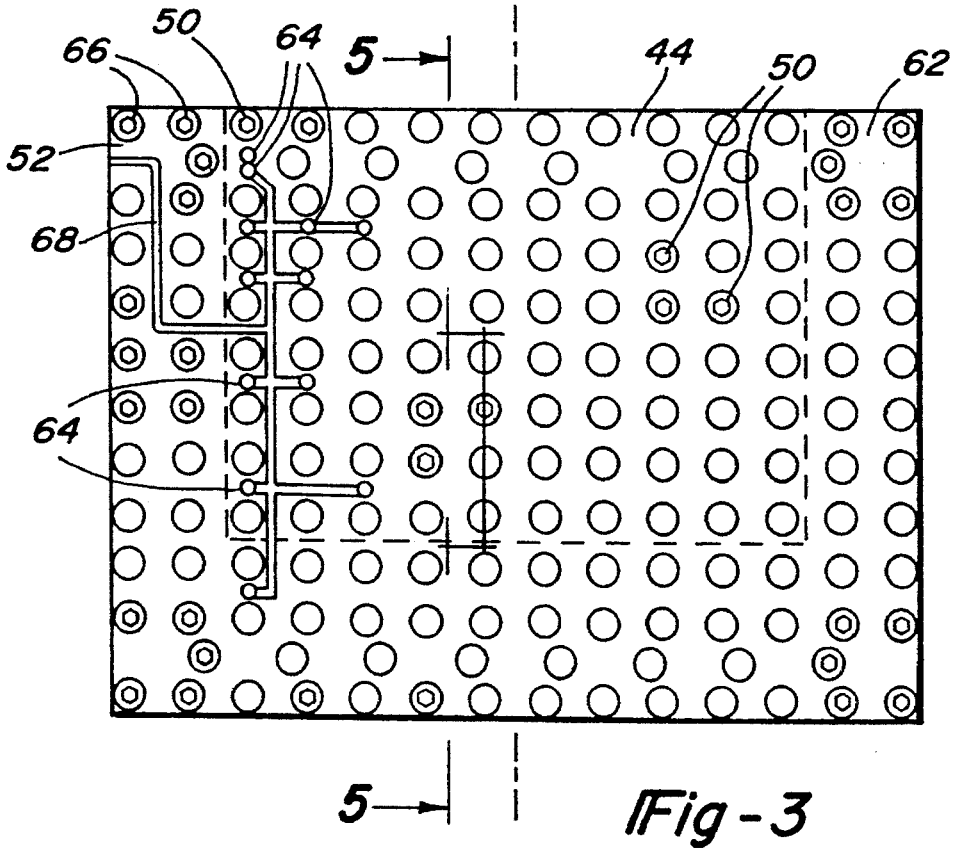
FIG. 3 is a plane view of the back of the steel backing plate with a copper facing plate fastened to it.

FIG. 3 is a plane view of the back surface 62 of the steel backing plate 32 after the copper facing plate 28 is fastened to it. The dashed line area shown in FIG. 3 is the curved area 44 of the steel backing plate 32. All mounting studs 50 in this curved area 44 are fastened by the novel flexible mounting method.

Thermocouples 64, a total of twelve are shown in FIG. 3, are mounted into the steel backing plate 32 and the copper facing plate 28 at various locations for temperature control purpose. Mounting studs 66 shown outside the curved area 44 do not require the use of disc-shaped spring washers since the differences in thermal expansion between copper and steel are not severe at the flat area 52. Channels 68 are shown for mounting of the thermolcouples 64.

Figure 4:
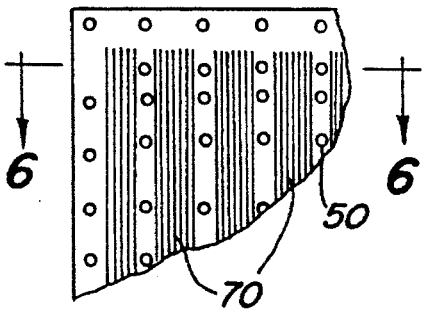
FIG. 4 is a partial view of the back of the copper facing plate showing the cooling channels and the mounting studs.
Figure 6:
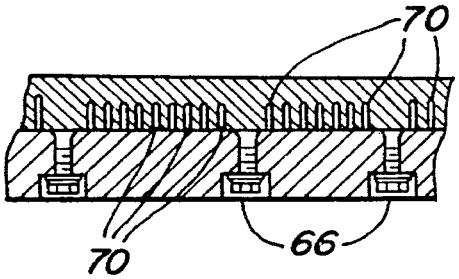
FIG. 6 is a partial cross-sectional view of the copper facing plate mounted to the steel backing plate taken along line 6—6 in FIG. 4.

FIG. 4 is a sectional view of the back of copper facing plate 28 showing cooling channels 70 and mounting studs 50. Cooling channels 70 are machined into the back of the copper facing plate to a predetermined depth such as 50% of the total thickness of the copper plate. This is shown in FIG. 6. The cooling channels 70 increase the contact area of the copper facing plate 28 with cooling water such that the cooling efficiency is greatly improved. As shown in FIG. 6, mounting studs 66 are located in the flat portion 52 of the steel backing plate 32 and do not require the use of disc-shaped spring washers. A commonly used disc-shaped spring washer in the present invention is the Bellevilles type spring washer.

Figure 5:
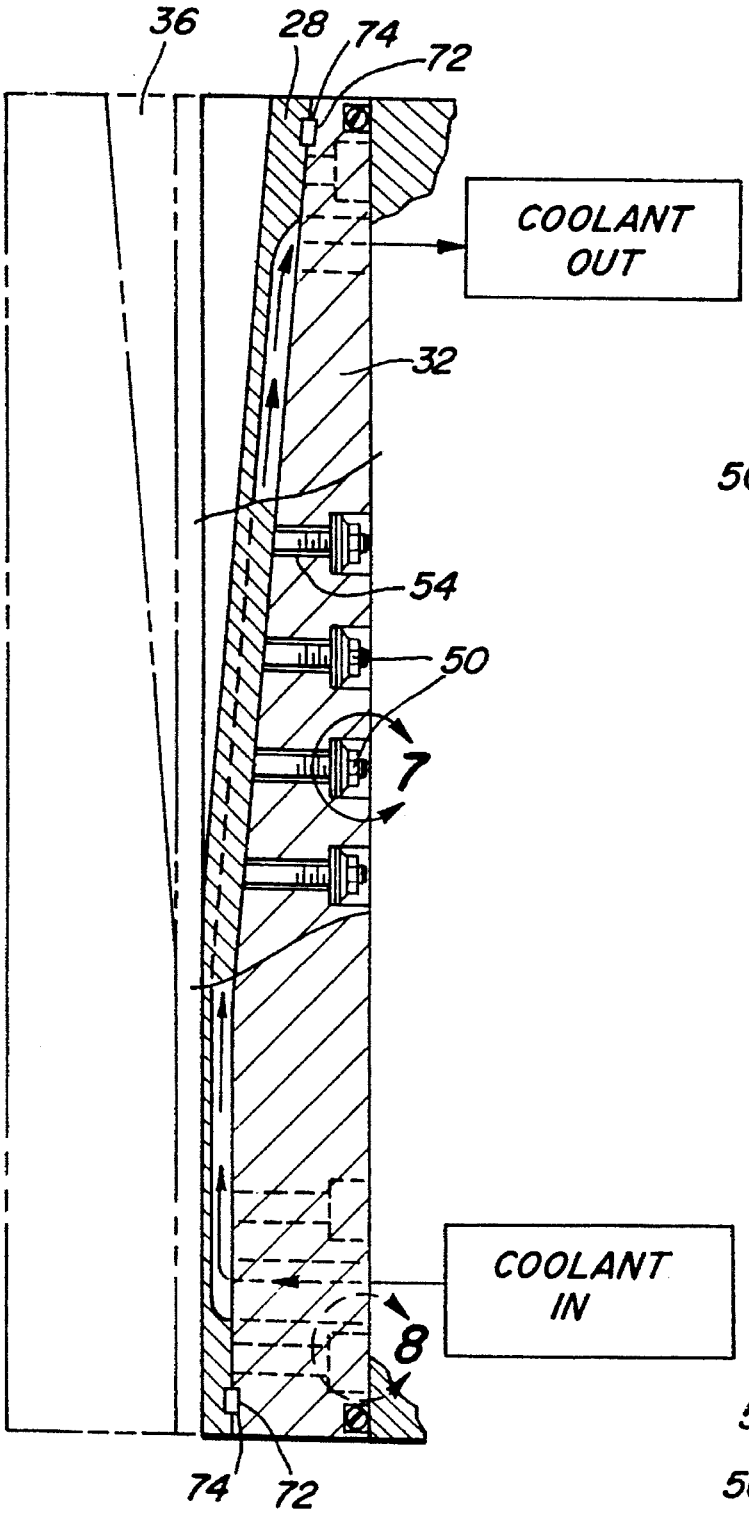
FIG. 5 is a cross-sectional view of the copper facing plate mounted to the steel backing plate taken along line 5—5 in FIG. 3.
Figure 7:
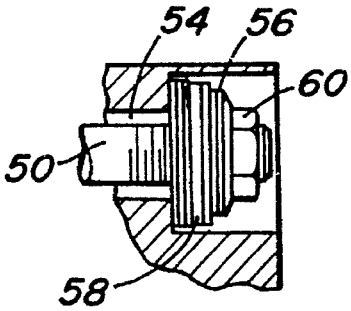
FIG. 7 is an enlarged partial cross-sectional view of the flexible mounting arrangement in which at least one disc-shaped spring washer is used.
Figure 8:
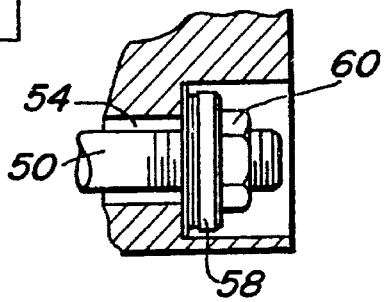
FIG. 8 is a partial cross-sectional view of a conventional mounting arrangement where no disc-shaped spring washer is used.

FIG. 5 is a cross-sectional view of the copper facing plate 28 mounted to the steel backing plate 32 taken along line 5—5 in FIG. 3. A groove 72 is provided in the interface between the two plates to allow for the installation of a gasket 74 to seal off the cooling water circulating between the two plates. The opposite copper facing plate and steel backing plate which form the funnel-shaped opening 36 is shown in ghost lines in FIG. 5. FIG. 7 shows an enlarged cross-sectional view of a mounting stud 50 fastened to a nut 60 by two disc-shaped spring washers 56 and a gasket 58. FIG. 8 shows an enlarged cross-sectional view of a mounting stud 50 in a fastened position by a nut 60 and gasket 58 without the use of disc-shaped spring washers.

Figure 2A:
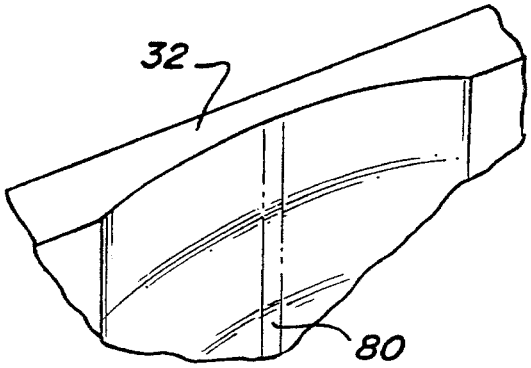
FIG. 2A is an enlarged perspective view of the flat plateau area at the center of the curved surface of the steel backing plate.

In an alternate embodiment of the present invention, a flat plateau area 80 at the center of the curved surface of the steel backing plate 32 of approximately ⅛ inch wide and runs along the whole length of the plate is provided. This is shown in FIG. 2A. This flat plateau region further reduces thermal stresses on the copper facing plate 28 by providing clearance for the expansion of the copper facing plate at its center line 82 such that it moves freely in either direction of the center line.

It should be noted that while copper is illustrated as the metallic material used in the facing plate in the preferred embodiment, the novel casting mold of the present invention can use any other suitable metallic material. Specifically, any other metallic materials that has high thermal conductivity.

While the present invention has been described in an illustrative manner, it should be understood that the terminology used is intended to be in a nature of words of description rather than of limitation.

Furthermore, while the present invention has been described in terms of a preferred embodiment and an alternate embodiment, it is to be appreciated that those skilled in the art will readily apply these teachings to other possible variations of the invention.

I claim:

1. A continuous metal casting mold comprising an insert and a mold frame from which said insert ,may be removed for service, said insert comprising:

a pair of primary plate-like mold members juxtaposed in a spaced substantially parallel relationship with each other, each primary plate-like mold member having a copper facing plate, a steel backing plate and fastening means between said coppers facing plate and said steel backing plate, said copper facing plate having a central upper portion expanding outwardly providing a downwardly converging funnel-shaped area to receive molten metal, said steel backing plate having a contour in the surface facing the copper facing plate that mates with the funnel-shaped area of the copper facing plate, and cooling means between said copper facing plate and said steel backing plate, a pair of end mold members opposing each other and situated between said primary plate-like mold members laterally outwardly of said funnel-shaped area, said end mold members are each equipped with a copper surface, and a generally box-like open-ended sleeve formed by said pair of primary plate-like mold members and said pair of end mold members having a top inlet for accepting molten metal and a bottom outlet for discharging partially solidified metal slab.

2. A continuous metal casting mold according to claim 1, wherein said fastening means is a floating fastening means.

3. A continuous metal casting mold according to claim 1, wherein said fastening means comprises a plurality of mounting studs situated on the non-casting side of said copper facing plate a plurality of mounting holes in said steel backing plate mating to said plurality of mounting studs, at least one disc-shaped print washer mounted on each stud located in the central upper portion of said copper facing plate, and nuts threadedly engaging said studs, whereby said fastening means allows relative movement between said copper facing plate and said steel backing plate caused by the different thermal expansion in said two plates and avoids stress transfer from said steel plate to said copper plate.

4. A continuous metal casting mold according to claim 3, wherein said mounting holes in said steel backing plate have a diameter larger than the diameter of said mounting studs to allow lateral movement of said mounting studs in a fastened position.

5. A continuous metal casting mold according to claim 3, wherein said mounting studs are tapped and threaded into the non-casting side of said copper facing plate.

6. A continuous metal casting mold according to claim 3, wherein said mounting studs are welded to the non-casting side of said copper facing plate.

7. A continuous metal casting mold according to claim 1, wherein said cooling means comprises channels provided in at least zone of the surfaces of the non-casting side of said copper facing plate and the side of the steel backing plate that faces said copper facing plate.

8. A continuous metal casting mold according to claim 1, wherein said primary plate-like mold member further comprises sealing means between said copper facing plate., and said steel backing plate for containing said cooling means.

9. A continuous metal casting mold according to claim 1, wherein said insert is of a 4-piece construction with two primary plate like mold members abutting two end mold members.

10. A continuous metal casting mold according to claim 1, wherein said copper facing plate is forged and said steel backing plate is machined.

11. A continuous metal casting mold according to claim 1, wherein said steel backing plate further comprises at the center of said contoured surface a flat plateau area for allowing movements of the copper facing plate caused by thermal expansion.

12. A continuous metal casting mold according to claim 1, wherein said copper facing plate having uniform thickness throughout its entire surface area such that thermal stress is minimized and thermal cracking is avoided.

* * * * *